United States Patent [19]

Persson

[11] Patent Number: 4,502,169

[45] Date of Patent: Mar. 5, 1985

[54] APPARATUS FOR TURNING A PERSON CONFINED TO BED

[76] Inventor: Torsten Persson, Havstenssund 7583, S-450 81 Grebbestad, Sweden

[21] Appl. No.: 401,354

[22] Filed: Jul. 23, 1982

[30] Foreign Application Priority Data

Jul. 27, 1981 [SE] Sweden ..... 8104546

[51] Int. Cl.[3] ..... A61G 7/10

[52] U.S. Cl. ..... 5/88; 5/84; 5/85; 5/61; 192/45; 192/67 R; 192/93 R

[58] Field of Search ..... 5/61, 65, 83–86, 5/88, 89; 192/45, 67 R, 93 R

[56] References Cited

U.S. PATENT DOCUMENTS

| | | | |
|---|---|---|---|
| 661,978 | 11/1900 | Hall | 192/45 |
| 1,078,090 | 11/1913 | Foss | 5/88 |
| 1,487,150 | 3/1924 | Deakins | 5/88 |
| 1,648,996 | 11/1927 | Reibel | 192/67 R |
| 2,429,865 | 10/1947 | Bresch | 5/86 |
| 2,655,667 | 10/1953 | Burkert | 5/61 |
| 2,919,000 | 12/1959 | Claytor | 192/45 |
| 3,302,219 | 2/1967 | Harris | 5/61 |
| 3,383,717 | 5/1968 | Underwood | 5/88 |
| 4,270,234 | 6/1981 | James | 5/61 |
| 4,285,496 | 8/1981 | Coles | 192/93 R |

*Primary Examiner*—Alexander Grosz
*Assistant Examiner*—Michael F. Trettel
*Attorney, Agent, or Firm*—Browdy and Neimark

[57] ABSTRACT

An adjustable frame 6 to 20 applied to a bed, supports selectively rotatable rolls 21, 22 at the level of the bed mattress 2 in parallel and close relation thereto. Said rolls are connected to an electric motor 66 via driving chains 40 around the underside of the bed. A draw sheet 28 extends between the rolls across the upper side of the bed and is wound on both rolls with the patient on the draw sheet. A control box 72 operating on low voltage (e.g. 24 V) current enables the patient or a nurse to turn on the electric motor to rotate in one direction or the other. Each roller is provided with an automatic driving and free wheel clutch 34 providing for driving of each roll only in one direction, namely the direction of reeling, so that when the one roll is being driven the other is freely rotating and vice versa. Furthermore, each driving and free wheel clutch unit 34 can be manually connected and disconnected by use of an external eccentric 48.

11 Claims, 15 Drawing Figures

Fig. 5
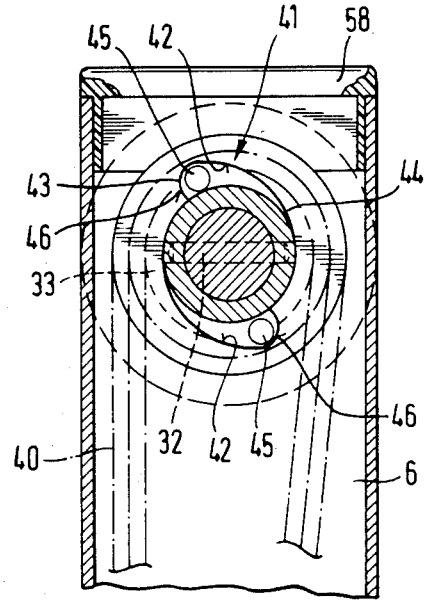
Fig. 6
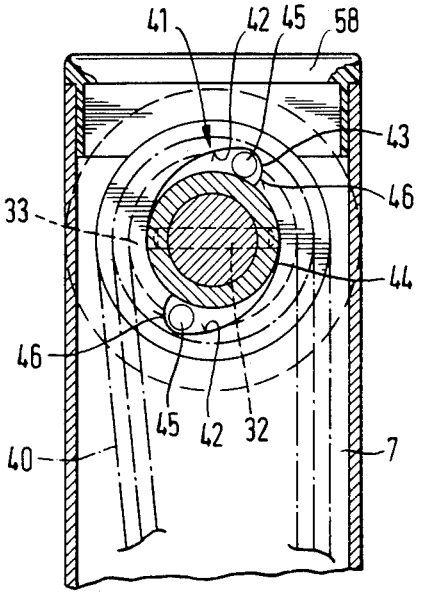
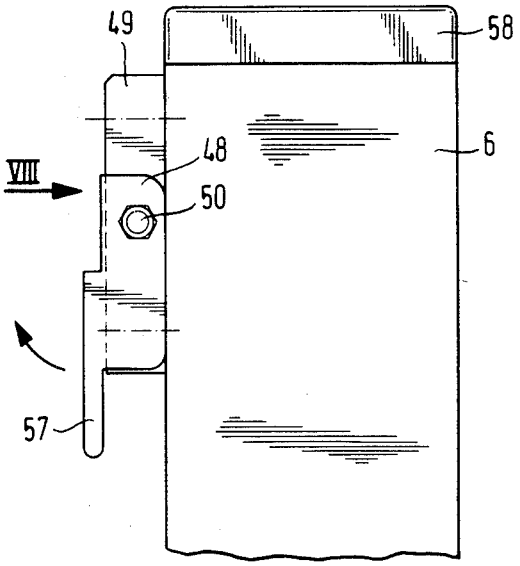
Fig. 7
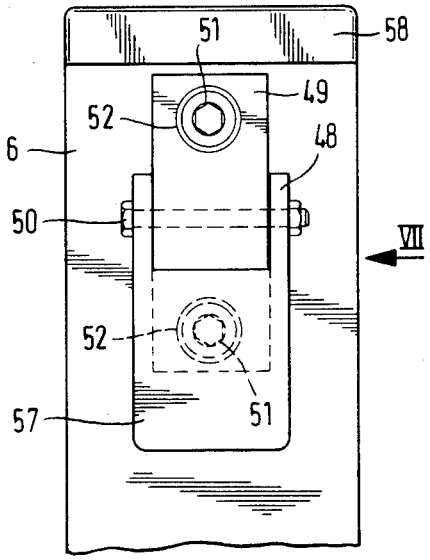
Fig. 8

APPARATUS FOR TURNING A PERSON CONFINED TO BED

DESCRIPTION

The present invention concerns apparatus for turning a person confined to bed.

A very great and so far unsolved problem, especially in prolonged care of a person confined to bed, is the turning of the person between positions resting on his different sides and his back and maybe resting on his stomach. Nursing personnel hardly have time to turn a patient more often than a few times per day and when this is carried out, it involves great difficulties and heavy lifting, which is completely undesirable and can often adversely affect the backs of the personnel. One person can hardly turn a patient alone; therefore, often two or three persons are occupied and help each other with the turning of patients. The long intervals between the turnings can give rise to severe bedsores, entailing extra care, which is time-and money-consuming. If a person is turned only a few times per day, one has to remember, that this ought to take place hourly and preferably according to the individual wishes of the patient for achieving the best possible treatment result, but often the available manual care cannot even approach such result.

In so far as mechanically-driven and especially motor-driven aids for turning of patients are previously known or can be considered to be used for such a goal, these in general have proved to be far too complicated and therefore susceptible to breakdown and risks of various kinds. They are also too bulky and expensive or entail hygienic problems, and may demand expensive special base and additional equipment. As a result, practical application and especially use on an extensive scale, such as in long care wards and clinics have been avoided. Thus no help is afforded by them to any substantial number of patients or nursing staff.

An object of the invention is, therefore, to provide a form of apparatus for turning of a person confined to bed, which apparatus can be manoeuvred without risks and can be constructed so as to be operated by the patient himself, without assistance of any care personnel. Furthermore, such apparatus should be simple in operation, as well as relatively inexpensive to manufacture. Also adaptation to conventional bed constructions should be achievable easily and simply by unskilled persons. Exchange of parts shall be possible quickly and simply and high hygienic demands need to be taken into account. Both assembly and dismantling as well as storage and transport should be achievable simply and quickly and high demands as to function and life time shall be fulfilled. A further objective of the invention is to improve techniques in this area in other special and general aspects.

These objects are achieved according to the invention by providing apparatus for turning a person confined to a bed, chararacterized by support means, preferably of U-shaped configuration, surrounding the bed in the middle and from below, shanks or posts of which support means extend up to mattress level and carry in this area, one along each long side of the bed, a pair of driven rollers which are parallel to the bed, of which rollers only one can be driven at a time, while the other at the same time is intended to be freed, and a draw sheet connected to both rollers and extending across the upper side of the bed, which draw sheet is of a width which corresponds to a part only of the bed length only.

The invention will be described further, by way of example, with reference to the accompanying drawings, in which:

FIGS. 5 and 6 are sectional views of the upper ends of the legs of the apparatus, on the driving side thereof and corresponding to the lines V—V and VI—VI respectively in FIGS. 1 and 4;

FIG. 7 is a partial view taken from the left in FIG. 4 and as indicated by the arrow VII of FIG. 8;

FIG. 8 is a view taken as indicated by the arrow VIII in FIG. 7;

FIG. 9 is a side view of a second embodiment of the apparatus of the invention;

Figure 1:
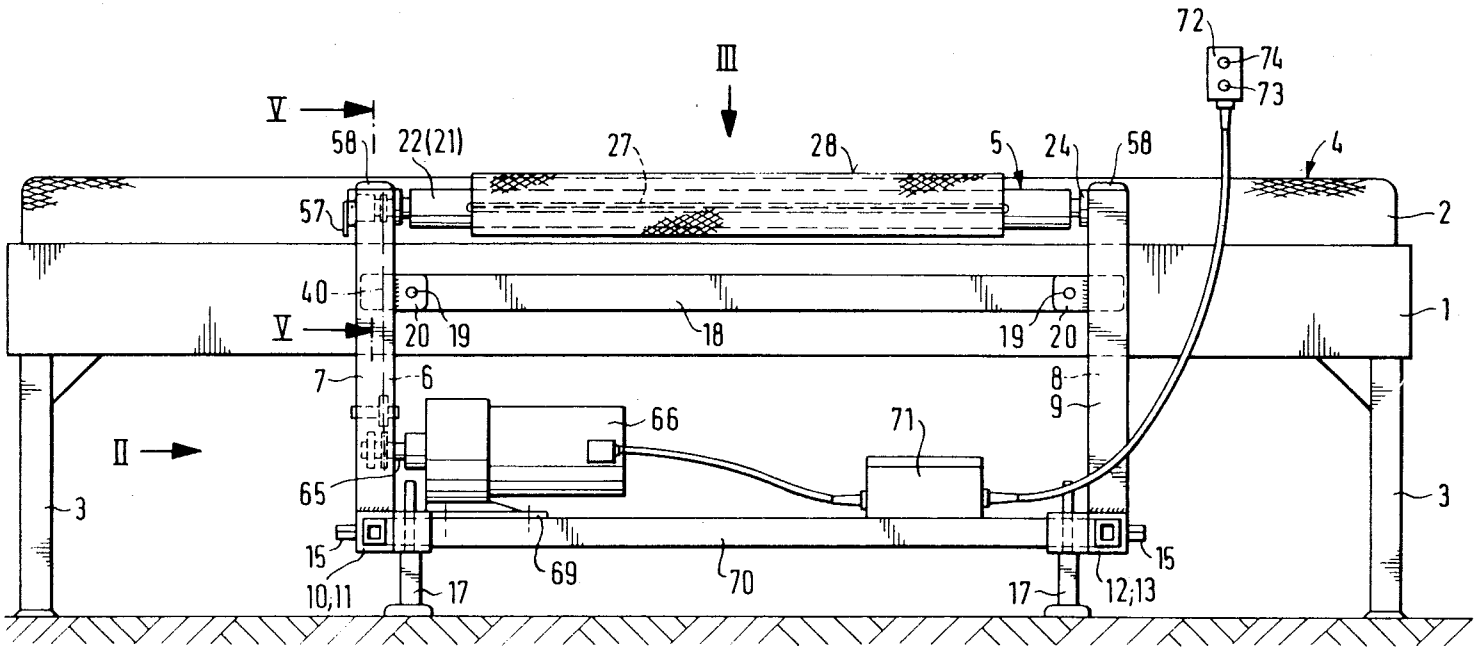
FIG. 1 is a side view of a preferred embodiment of the apparatus of the invention applied to a bed.
Figure 2:
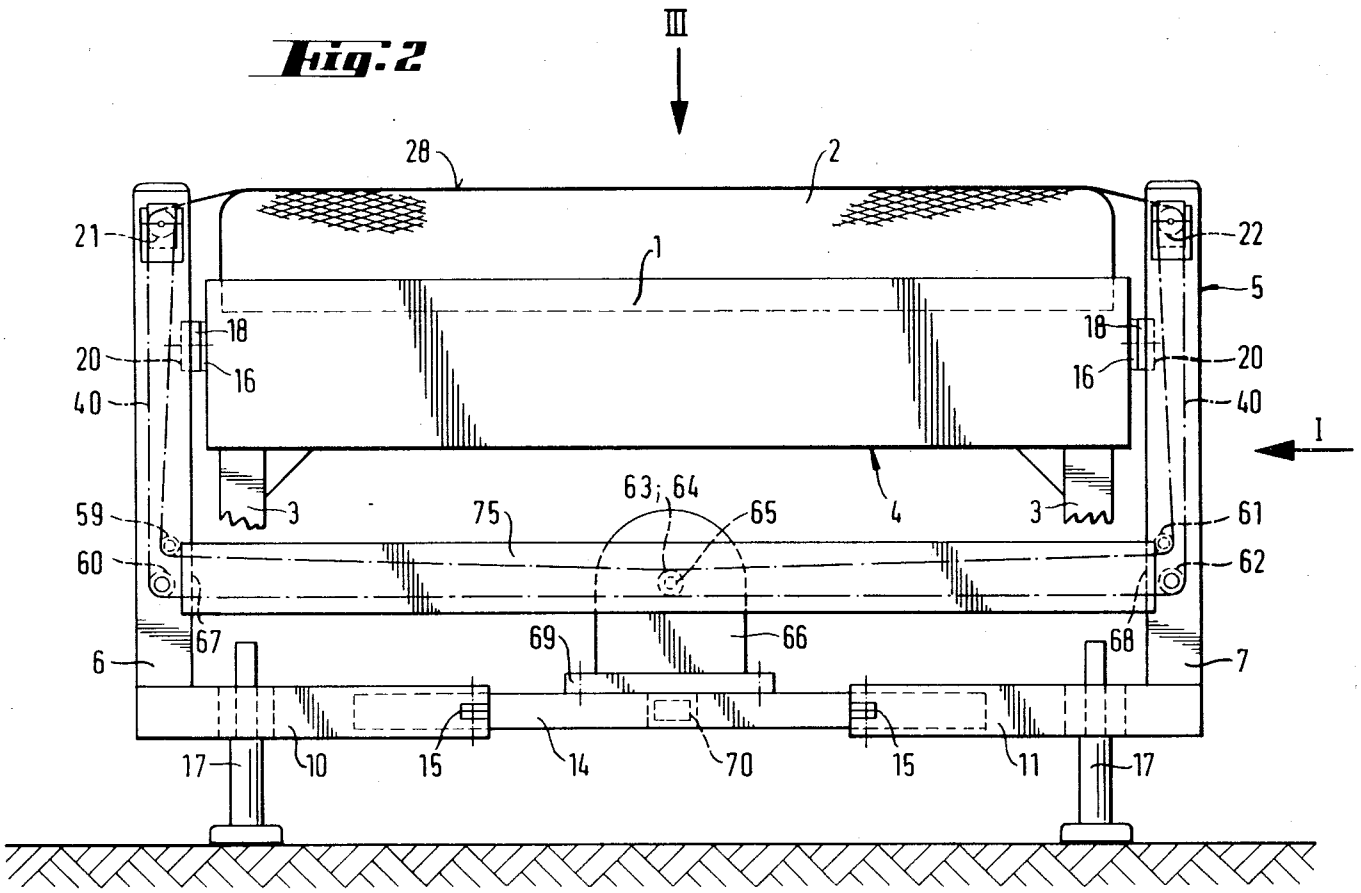
FIG. 2 is an enlarged view, partly in section, taken from the left in FIG. 1, as indicated by the arrow II.
Figure 3:
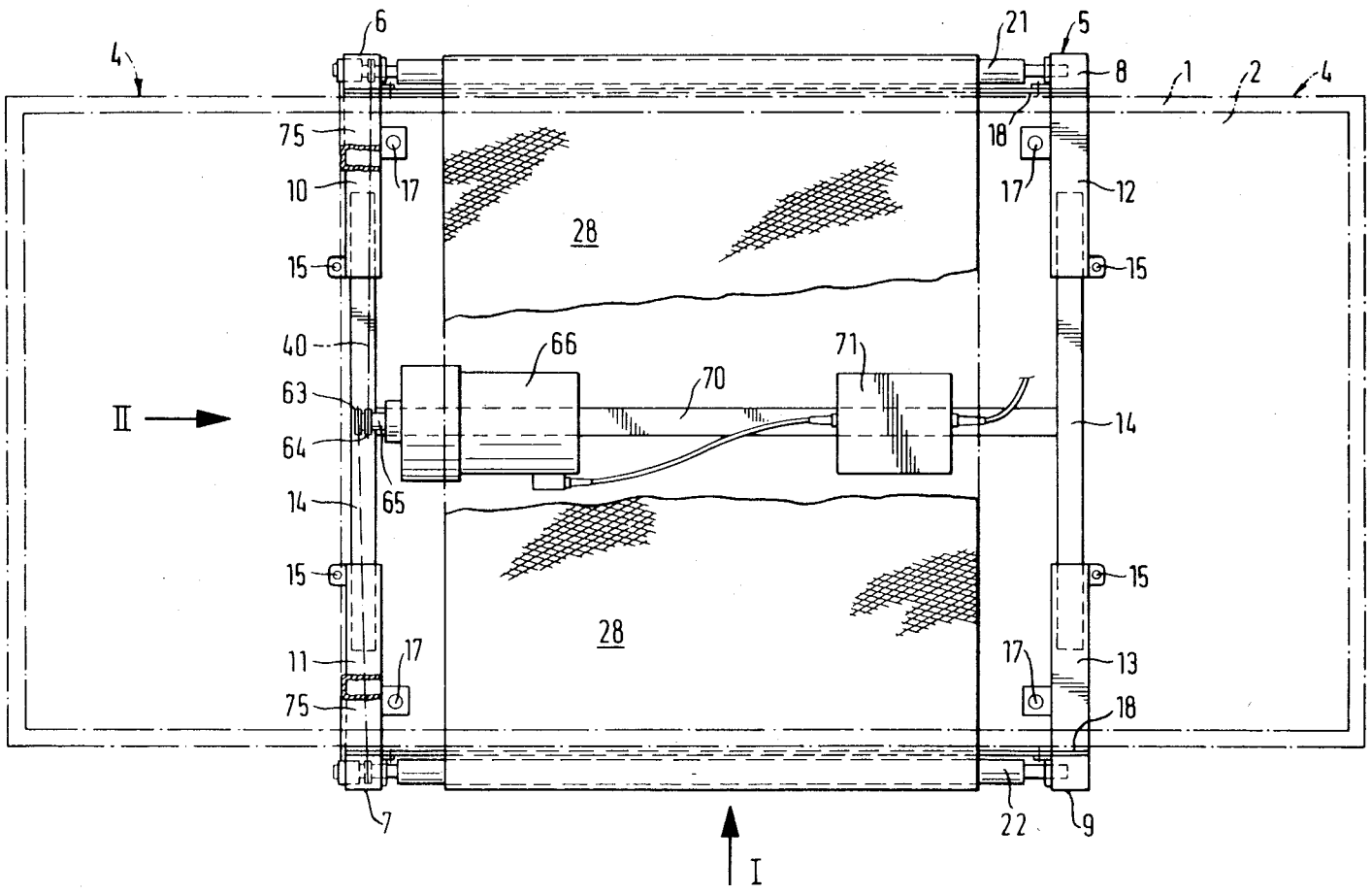
FIG. 3 is a plan view of the apparatus of FIG. 1 and taken as indicated by the arrows III in FIGS. 1 and 2.

Referring firstly to FIGS. 1 to 8 of the drawings, the reference numeral 1 designates a bed base on which is supported a mattress 2, and which in turn is supported by a leg or post arrangement 3. The whole bed is designated by the numeral 4. Considered in relation to the length of the bed, preferably at about the middle there is a preferred embodiment of the apparatus of the invention designated by the numeral 5, this being disposed under or around the bed. The apparatus comprises preferably vertical legs or posts 6 to 9, preferably rectangular tubes. Of these, posts 6 and 7 are arranged as a pair at the driving end of the apparatus, which can be closest to the head end of the bed. The posts 8 and 9 constitute the undriven end of the apparatus, which preferably is closest to the foot end of the bed. Each of these pairs of posts, comprising a post at each side of the bed, is interconnected by a respective traverse made of matching profiles, for instance rectangular pipes 10 and 11, as well as 12 and 13, respectively, which preferably interconnect the lower ends of the respective posts and are welded by one end thereto. Alternatively, tubes or the like of the same diameter may be attached to the posts, with the connection between them being a minor or larger tube or the like 14 as shown in FIG. 2.

Provided in the vicinity of the connections are locking means 15 (not shown in detail) and being previously known for locking the matching tubes or the like to each other, so that a fast and simple adjustment of the width of the device is possible in order to adapt the apparatus to various different bed widths. In this connection, preferably spacers 16 of some kind are placed between the posts and the bed base 1. These spacers may be loose or attached to the posts and are e.g. adjustable, for instance by means of some form of screw device of known type. It is, of course, desirable to achieve a tensioned unit consisting of the bed and the device according to the invention for achieving a stable, tough and non-bulky construction, which nevertheless can be constructed so as to be relatively light and reliable in function. To the traverses and/or posts are attached adjusting means 17 for height adjustment of the apparatus according to the invention, e.g. as legs which in a known way can be screwed in and out. This makes possible easy cleaning of the floor below the apparatus.

The posts at each side of the bed, i.e. one post of each pair, are interconnected by a respective strut 18 at a certain distance, e.g. about 15 to 20 cm from the upper ends of the posts. Such a strut may be made of a flat iron profile which, by means of screws or the like 19 is attached to a base plate 20, which projects from each post and is e.g. welded to the same. In this way, a unit consisting principally of posts, traverses and struts is achieved, which is stable in its construction but is nevertheless adjustable. The struts may be adjustable in their length. This is hardly necessary, but different lengths of the apparatus according to the invention may be required and this can then easily be achieved by the choice of strut lengths without variation of the rest of the apparatus.

In parallel relation to the struts, above the latter and between said post ends are driven rollers 21 and 22, respectively. Each of these extends at the respective bed side and is supported by the posts, preferably by a ball bearing 23 having a bearing housing 24, which latter may be welded to the posts, whilst the ball bearing is secured by an annular washer 25 inserted into a groove 26 in said housing. The rollers are preferably each made of cylindrical tubing of stainless steel having a longitudinal slot 27, which ends e.g. 5 to 10 cm from the roller ends. This slot may be approximately 5 mm wide and is intended for insertion of one end of a draw sheet 28, which preferably is considerably narrower than the slot is long, so that the sheet can be applied at any location along almost the entire roller length, which may, for example, be 80 to 100 cm. Experience shows that simple insertion or attachment of the draw sheet is both sufficient and advantageous as this means that a user can never tear the draw sheet, even if the apparatus according to the invention should be operated incorrectly, because if the sheet should be rolled up too much onto the one roller it will simply slide out of the slot in the other roller, which may be an advantage especially for exchange of sheets, both as to removing used sheets and installing fresh ones. Nevertheless these advantages do not prevent use of an attachment device of different types if so desired.

Inserted into each roller end, and preferably welded therein, is a cylindrical body 29 with a concentrically-extending support bolt 30 at the undriven end and a support and driving bolt 31 at the driven end of the apparatus. Around each bolt base there is preferably provided a tear ring 77 of plastic. In both cases, the bolt can extend to a small extent into the respective post, but the driven bolt 31 is preferably considerably longer and extends almost right through the respective post and, within the latter, is provided with a diametrically-extending clutch pin 32 for engagement with recesses 33 in a driving and freeing unit designated generally by the numeral 34, which unit 34 is provided on said bolt 31 and in the interior and outside the respective post. This unit comprises firstly an engagement cylinder 35 which in principle is freely rotatable on said bolt 31 and the end of which, turned away from the roller, ends at distance from both the nearest inside of the post and the free end of the bolt 31 as a surrounding and extending flange 36, whilst the other cylinder end is provided with an outer thread 37 on to which is screwed a stop ring 38. This threaded cylinder end 37, and possibly also the stop ring, are provided with said recesses 33, which may be provided at several diametrical locations, e.g. at angular spacings of 60°, so that the pin 32 never has far to slide to engage into the next pair of recesses.

Figure 4:
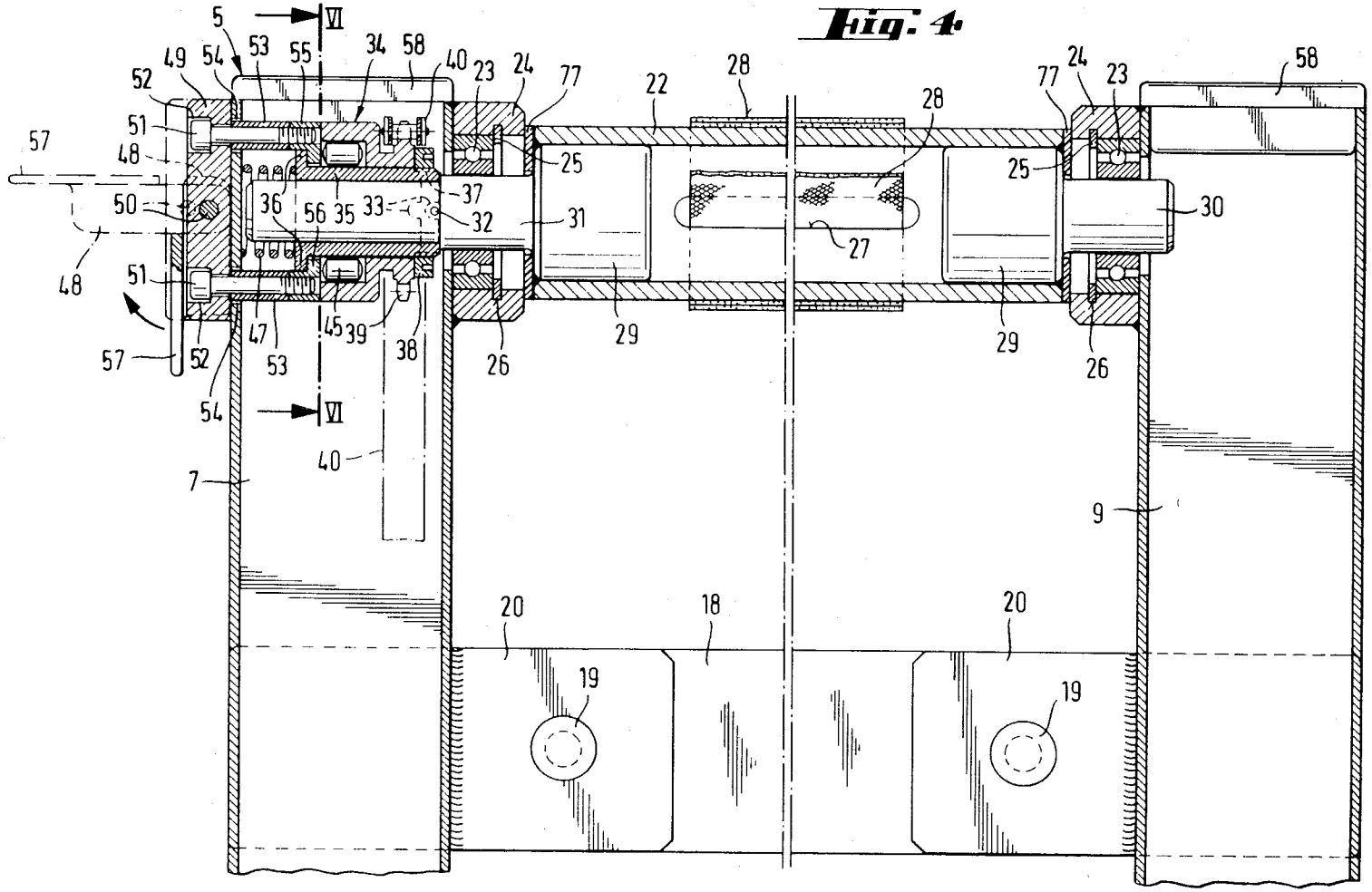
FIG. 4 is an enlarged fragmentary detail view according to part of FIG. 1, partly in section.
Figure 4:
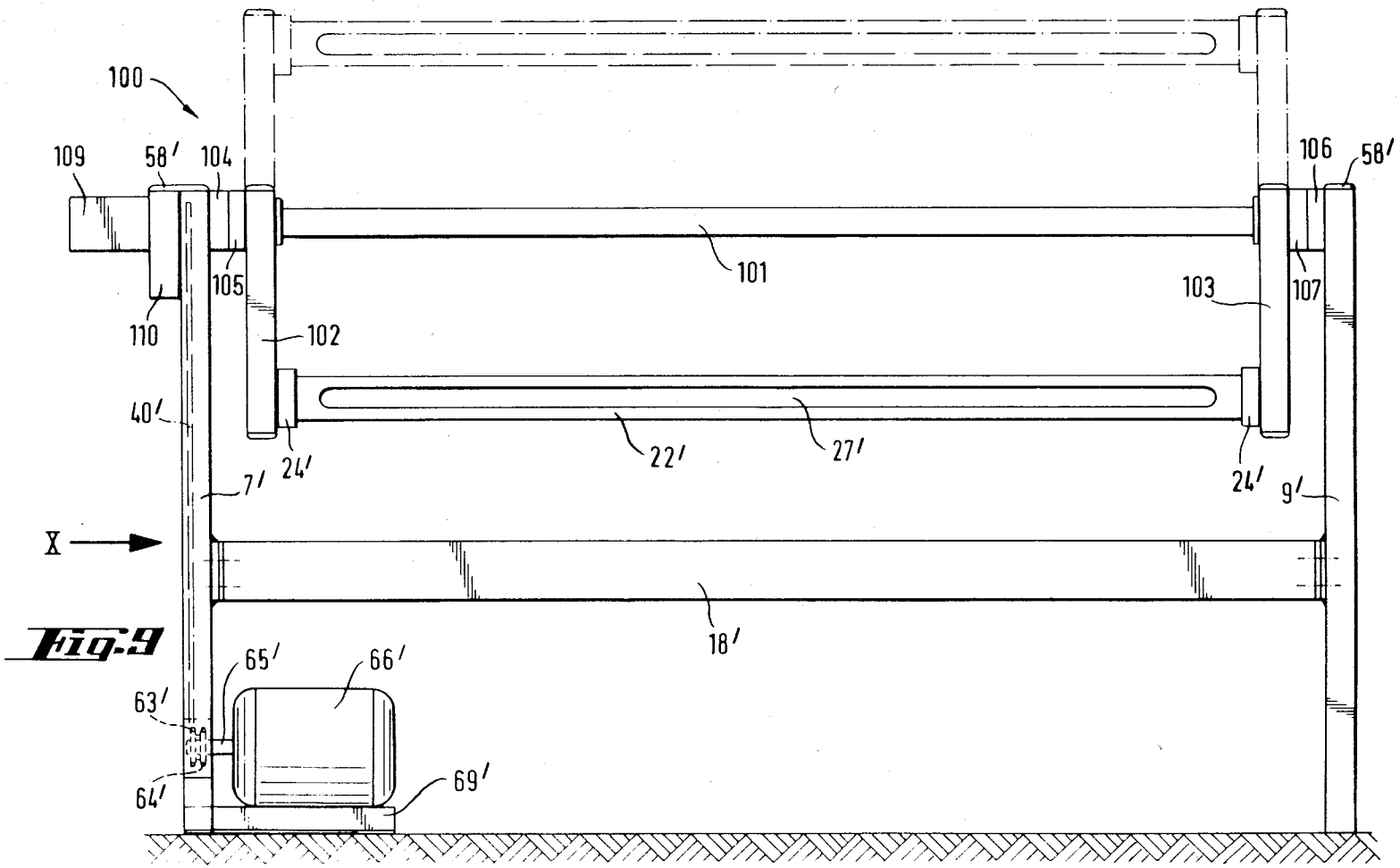

The engagement cylinder 35 carries, close to the stop ring, a tooth wheel 39 which in principle is freely rotatable and on which is provided an endless driving chain 40, preferably a roller chain, which extends downwards in the post in a manner described in greater detail below. The tooth wheel 39 is provided with a clutch 41 effective relative to the cylinder 35, e.g. in that that end of the tooth wheel 39 which is turned away from the stop ring 38 is provided with preferably two diametrically arranged interior recesses 42, the one end 43 of which, in the circumferencial direction, extends substantially radially away from the cylinder, forms a softly rounded cavity 46 for a locking roll 45 of somewhat smaller diameter then the greatest depth of the cavity or extension in radial direction, and merges gently into the other end of the cavity or recess 44 by continuous approach in tangential direction towards and final abutment with and termination at the cylinder. Both recesses are shaped in an analogous way in the same circumferencial direction. This means that rotation of the tooth wheel clockwise in FIG. 5 will neutralize the locking rolls, whilst as shown in FIG. 6 these will be pushed out of and against the more flat part of the recess when the tooth wheel is turned clock-wise, whereby parts 35, 39 and 45 will lock each other and rotate together and turn the roller 22 provided that the pin 32 extends into the recesses 33. Such an engagement is safeguarded by a pressure spring 47 which surrounds, the outer end of the bolt 31, abuts the adjacent interior side of the post and by pressing against the flange end 36 tends to move the cylinder in the direction towards the roller and thus biasses the recesses into engagement with the pin. Such engagement can be released by an eccentric 48 on the outer side of the post which is turned away from the roller, which eccentric is guided for example at a vertical and oblong base plate 49 on a shaft 50 which extends through the middle of the base plate and side shanks of the eccentric i.e. the eccentric may be U-shaped in a cross-section. The base plate 49 is penetrated by upper and lower hexagon screws 51, which extend through holes 52 in the base plate and holes 54 in the post as well as through guiding sheels 53 in the post and are screwed into an engagement ring 55, which by means of an interior flange 56 extends into the space between the flange 36 and the tooth wheel 39, so that eccentric movements affect the entire relatively tight unit formed by parts 33 to 46, 48 to 53, as well as 55 and 56. In FIG. 4, the driving or engagement position is shown in full lines and the freed position is shown in dashed lines, in which latter position said parts are moved to the left, whereby the eccentric is in a horizontal position, in which projecting eccentric handle 57 can easily be actuated. The movement between the two positions will not affect the driving chain 40, as the chain length is not affected hereby. All of the post ends are preferably covered by easily removable and refittable plastic locks 58.

From FIGS. 1 and 2 it will be seen that the posts 6 and 7 and the driving end freeing units 34 are the same with the exception of the recesses 42, which are mirror-symmetrical, as will be seen from FIGS. 5 and 6, which means that a neutral or freed position on the one side always will correspond to an engaged or driving position on the other and vice versa. Each chain part is, in the vicinity of the lower end of the posts 6 and 7, turned from the outside and inwards by way of reversing rolls 59, 60 and 61, 62 respectively. Each chain part is then guided around its own tooth wheel 63, 64 respectively on one and the same driving shaft 65 of an electric motor 66, which can be a 220 V A.C. motor. The chain parts extend out of the posts through openings 67 and 68 respectively on the inner sides of the posts somewhat above the annexed traverse on which the motor 66 can be attached on a console 69. One or several strut beams 70 may extend between both traverses, on which strut beam the console and the motor can be arranged and possibly further equipment, for instance a transformer 71 for converting 220 V to 24 V operating current. The electrical equipment, of preferably low current type, includes also a manoeuvering unit 72 with a pressure button switch 73 for the one draw direction and a similar switch 74 for the other draw direction of the draw sheet 28. The lower horizontal chain parts leading to the motor are preferably entirely or partly surrounded by a chain protector 75, e.g. constituted by L- or U-profiles, which overlap each other in longitudinal and/or height or lateral direction, and which may be welded with one end to the respective post. Furthermore, at least one of the reversing rolls 59 to 62 may be shaped as a chain tensioner e.g. with a vertical groove in the posts 6, 7.

Such an apparatus according to the invention works in a very simple way. The apparatus is applied to a bed in the described and illustrated manner; the bed is made in the ordinary way with the draw sheet lying above an ordinary sheet or the like, whereafter the patient can be positioned on the draw sheet roughly with the middle and heaviest part of the body on the sheet. A sufficiently long part of the draw sheet should, of course, be rolled up on each roller. If the patient now wishes to turn, then he or she will push one or the other of the buttons 73 and 74 depending on the direction turning is required to take place. The draw sheet is now drawn slowly, e.g. at a speed of approximately 5 cm/sec, onto the engaged roller and is rolled up on to the latter. Meanwhile the sheet unrolls from the other roller, which consequently is also "driven", but which is freed as has been described with reference to FIGS. 5 and 6. Accordingly, disadvantageous tensions on the roller supplying the sheet are completely avoided, which tensions can arise e.g. as a result of the continuously increasing circumference of the winding-in roller, whilst the circumference of the other roller is diminished to a corresponding degree, which otherwise could result in an unbalance. In the desired position the patient releases the actuated button; later, as desired, the other button can be operated to initiate the opposite procedure. In general, such turning can be performed even by severly handicapped patients without assistance of personnel, whose work consequently is enormously eased in connection with turning patients, even if the patients themselves cannot perform the turning. In such a case, a nurse will only have to push the desired button and press gently against the upper side of the patient, when easy turning is achieved. Even heavy patients can be turned sideways in this way without the nurse having to exert any significant effort. The turning or "rolling" in the desired direction is made possible or easier, if the head and foot part is held against the drawing action in the middle. Experience shows, however, that patients learn very fast to contribute to and assist in the turning operation.

The transmission can be optionally selected, in each case, in known manner, so that an appropriately adjusted turning speed is achieved. Naturally, a power source other than an electric motor can be employed, but the latter would be most advantageous. For the drawing sheet, use is made of a web or the like which is resistant to tearing and has as low friction as possible. Should, nevertheless friction constitute a problem, then preferably a friction protector (not shown), in the form of a web or the like with suitable properties and of a width of approximately equal to that the draw sheet may be provided below the latter so as to be stationary relative to the bed. The ends of such a friction protector may be attached to the struts 18 or in other suitable locations. It should also be mentioned that it is advantageous for the draw sheet to be relatively long, e.g. 3 to 5 times the active length between the rollers, e.g. for hygienic reasons. When changing the draw sheet, it can firstly be rolled up entirely onto one of the rollers, which then is freed by actuating the respective eccentric, whereupon the sheet can easily be drawn off said roller. Fitting of a new draw sheet is then effected in the manner already described. When exchanging bed sheets, one will only roll up the draw sheet onto the one roller, whereupon the draw sheet is wound back onto the other roller as desired. The draw sheet does not have to be exchanged as often as, for instance, the bed sheet.

Referring now to FIGS. 9 to 15 the basic construction of the modified apparatus 100 according to the invention illustrated therein is similar in its main elements to what is shown in the preceding figures. The modified form of the apparatus comprises posts 6', 7', a strut 18', a driven roller 22' having a slot 27' and supported by bearing housings 24', as well as an electric motor 66' having a driving shaft 65' on a console 69', tooth wheels 63' and 64', a driving chain 40', and post caps 58'.

A principal difference from the previously described embodiment arises from the presence of swinging arms 102, 103 provided between and pivotably attached to the upper ends of the sides of the posts 6' and 7' which face each other. The free ends of these swinging arms carry the driving roller 22' between them, whilst a spacing strut 101 extends between the base ends of said arms. Between the base ends of the swinging arms and the upper post ends, there are housings 104, 105 and 106, 107, respectively, the first-mentioned being provided with an arresting means for arresting the swinging arms in desired positions. At the upper end of the post 6' and at the side which is turned away from the swinging arms, there is an electrical magnet 109, provided on an intermediate housing 110.

FIG. 9 shows, in full lines, a position of the driving roller, which is preferably a rest or non-active position, while the dash lines show the preferred working position.

Figure 10:
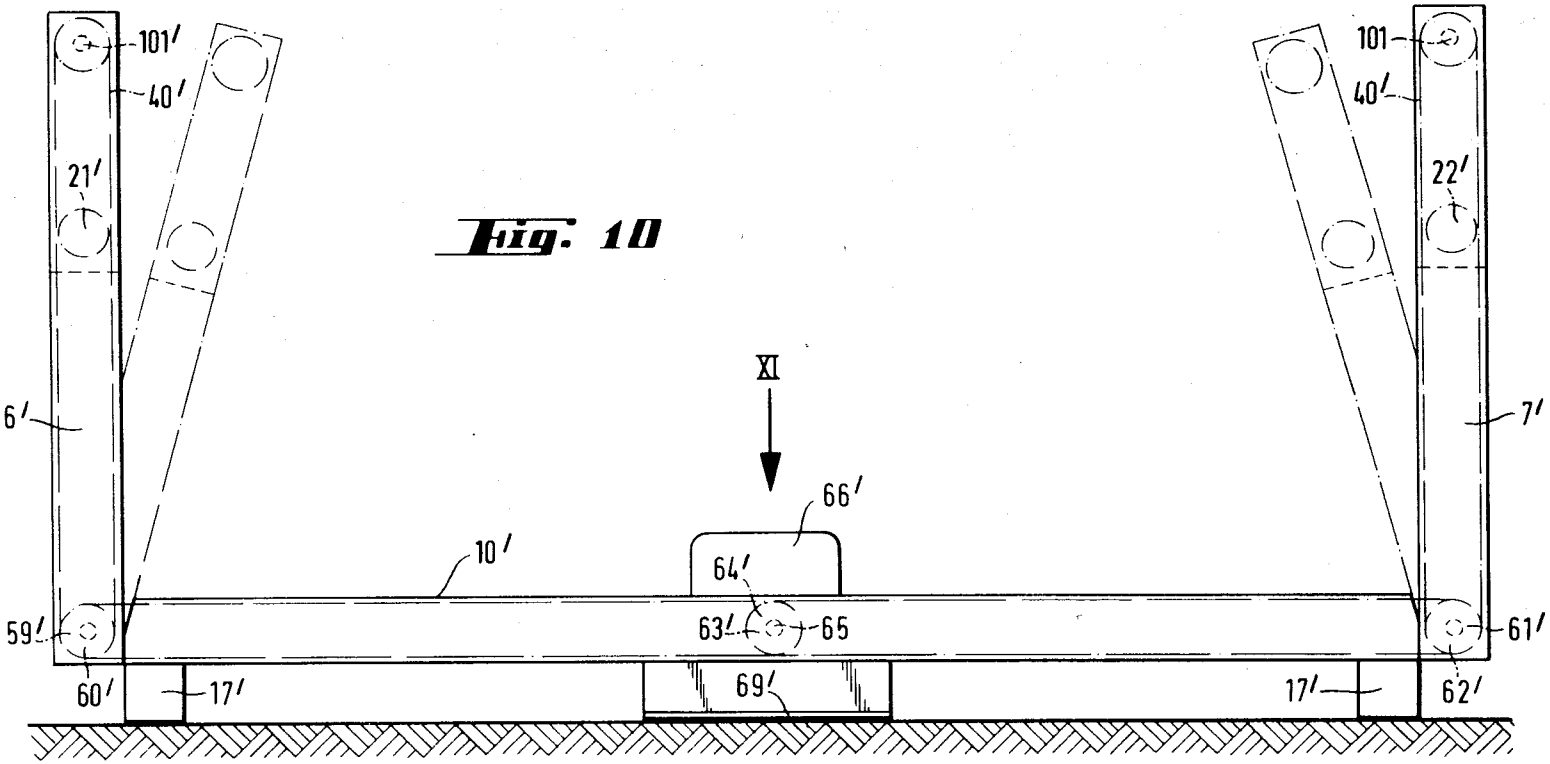
FIG. 10 is a partial view taken as indicated by the arrow X in FIG. 9 and showing the main parts of the apparatus.

FIG. 10 corresponds to FIG. 2 and shows the posts 6', 7' with spacing struts 101, 101', driving rollers 21', 22', driving chains 40', reversing wheels 59', 60' and 61', 62', a lower horizontal tube 10', means 17' for height adjustment and the electric motor 66' with its driving shaft 65', tooth wheels 63', 64' and a console 69'.

Figure 11:
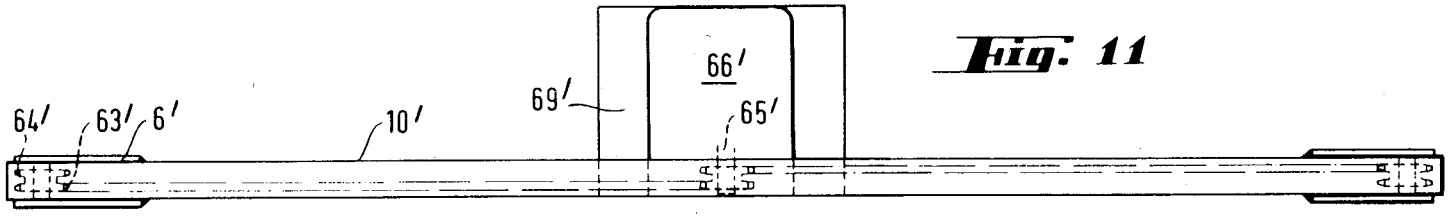
FIG. 11 is a plan view taken as indicated by the arrow X1 in FIG. 10.

FIG. 11 shows these parts seen from above.

Figure 12:
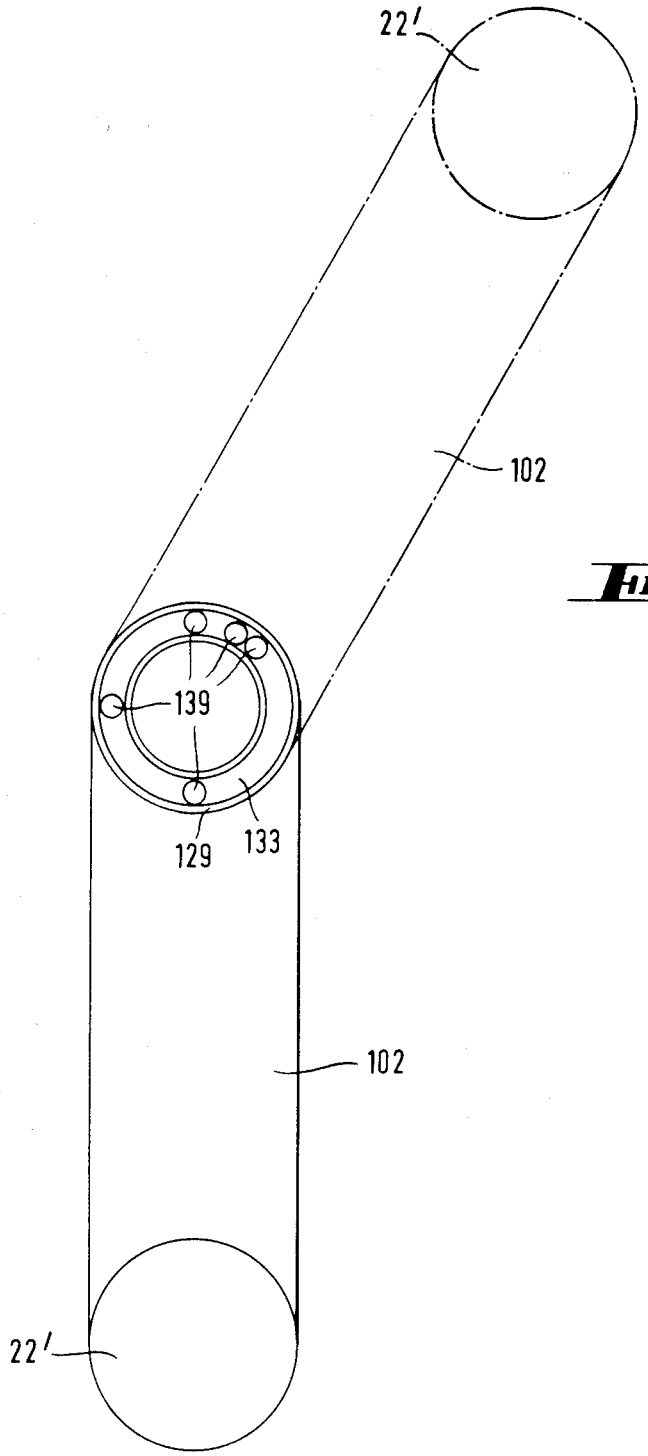
FIG. 12 is an enlarged diagrammatic view illustrating the end positions of swinging arms of the apparatus as shown in FIG. 9.
Figure 13:
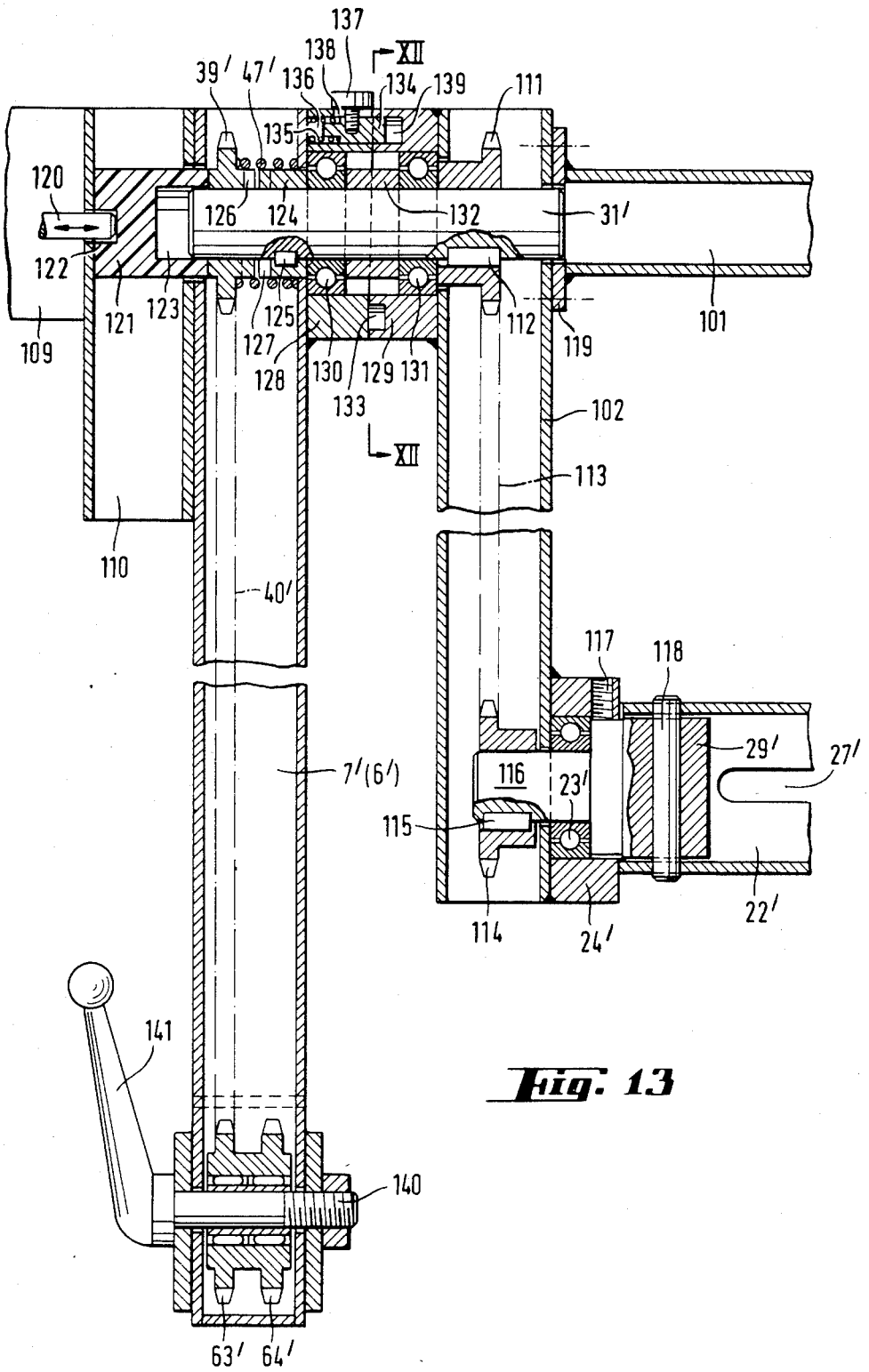
FIG. 13 is an enlarged sectional view illustrating the details of parts shown at the upper left hand side of FIG. 9.

FIG. 12 shows, partly diagrammatically, a view taken as indicated by the arrows XII—XII in FIG. 13 and shows the preferred end positions of the swinging arms with their driving roller.

FIG. 13 corresponds substantially to FIG. 4 and shows clearly the features which distinguish the modified apparatus of FIGS. 9 to 15 from that of FIGS. 1 to 8.

Each post 6' and 7' is provided with tooth wheels 63' and 64', from the first one of which a chain 40' leads to and around an upper tooth wheel 39' on a bolt 31', which is in driving connection with roller 22' via a tooth wheel 111 on its other end in relation to tooth wheel 39' with securing means 112 within the end of swinging arm 102 which is close to spacing strut 101. Around tooth wheel 111 extends an endless chain 113, which leads into the free end of the arm 102 and is there guided around a toothed wheel 114 having securing means 115 on a bolt 116, which bolt extends into housing 24' provided with bearing 23', which latter may be secured by a screw or the like (not shown) engageable into a threaded bore 117 in said housing. The bolt 116 is connected with a cylindrical body 29' inserted into roller 22' and secured by means of a traverse pin 118.

As can be seen, the swinging arms are preferably tubes with open ends and the struts 101 may be secured to the swinging arms by means of base plates 119.

At its side facing away from the strut 101, each post 7' and 6' is provided with an intermediate housing or the like 110 and an electrical magnet 109 with actuating pin 120.

Within the intermediate housing there is an engagement block or the like 121 having openings 122 and 123 in its opposite ends for retaining the actuating pin 120 and the bolt 31', respectively. Within each post 6' and 7', respectively, there is provided a pressure spring 47' around one end of toothed wheel 39' and an engagement base 124, which is connected to the bolt 31' by way of securing means 125. This spring keeps apart toothed wheel 39' and engagement base 124, the ends of which are provided with respective engagement sections 126 and 127.

Between each post 6' and 7', and its swinging arm 102, there extend around bolt 31' a respective housing 128, 129, having bearings 130, 131, which bearings are kept apart by means of a spacer ring 132. For instance, the axial end of housing 129 facing housing 128 is provided with a circumferencial groove 133, in which groove there is slidably provided arresting means 134 such as a bolt, which is influenced by a pressure spring 135 on the other side and guided in a bore 136 in housing 133, from which bore extends an outer actuating means 137 through an opening 138 in said housing 128.

At locations where the swinging arms 102, 103 are desired to be arrested, for instance in the positions shown in FIG. 12, arresting holes 139 extend from the groove 133. FIG. 13 shows that the arresting means 134 is in the course of sliding into one of such holes 139.

Figure 14:
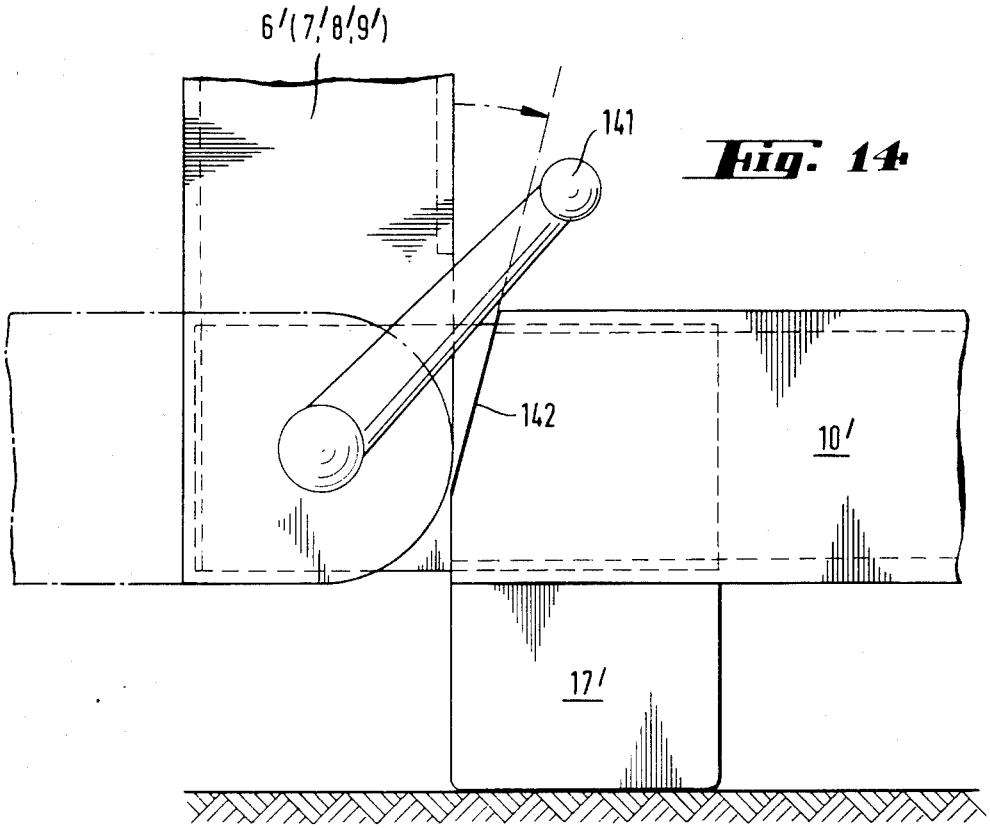
FIG. 14 is an enlarged view illustrating the details of parts shown at the lower left hand side of FIG. 10.
Figure 15:
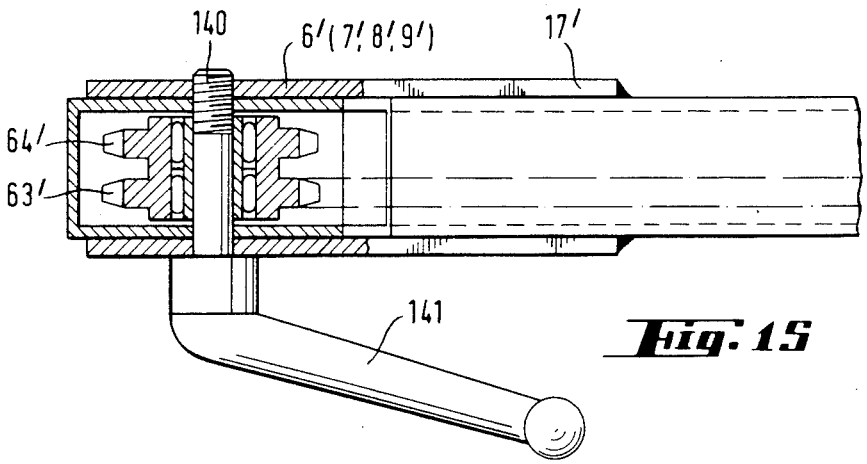
FIG. 15 is a sectional plan corresponding to FIG. 14.

Finally, the lower part of FIG. 13 and FIGS. 14 and 15 show means for arresting the posts in specific pivoted or inclined positions, for instance as shown in FIG. 10. For this purpose, the tubes or the like 10' or an extension of means 17' are provided with a bolt 140 with an outer lever 141, which bolt, in the posts 6' and 7', may carry toothed wheels 63' and 64'. As can be seen in FIGS. 14 and 15, the posts surround the respective end of the tube 10' and the bolt 140 extends through both of them and is screwed into the opposite side relative to the lever, so that turning the lever in one direction will arrest the respective post relative to tube 10', while turning the lever in the other direction will disengage this connection. In order to enable an inclined position such as is shown in FIG. 10 to be obtained one side of e.g. means 17' is provided with a bevel 142. As shown in FIG. 14, such a construction also contributes significantly to ease of application, mounting and dismounting of the embodiment of the apparatus according to the invention, as the posts can quickly and easily be swung up and down without dismantling the whole apparatus, or essential parts of the same.

This form of the apparatus works in a very convenient way and is particularly efficient for heavily handicapped people, as the driving rollers can be lifted up, as is evident from FIG. 9, to a level above the mattress of a bed, so that a greater part of the draw sheet will affect the body of the patient. It is convenient that the driving rollers can be swung down with the swinging arms as shown in full lines in FIG. 9, when the apparatus is not to be used or is to be used on a patient who does not require the roller position shown in dash lines. The apparatus can be actuated in both positions, in which case the patient or a nurse will push the desired button on the manoeuvring unit, which unit is connected to both the electric motor 66', and the electrical magnet 109. Then, the electrical magnet pushes out the actuating pin 120 to push the block or the like 121 to the right in FIG. 13 and simultaneously moves the toothed wheel 39' into engagement with the engagement base 124 via the described engagement sections, against the pressure spring 47', which is correspondingly compressed. Driving moment from the electric motor is transferred by the chains 40' to tooth wheels 39', engagement bases 124, bolt 31', toothed wheel 111, chains 113, toothed wheels 114, bolts 116 and cylindrical bodies 29' to the driving rollers 21' or 22' respectively. Thereby, the inclined position of the swinging arms is secured by the arresting means 134, which can easily be disengaged by the patient or a nurse, so that the swinging arms easily can be swung up or down into any desired position. In the event that the driving rollers are to be actuated in a lower position, the draw sheet can be drawn around strut 101 and slide around this strut.

As can be understood, in this case the driving rollers are always disconnected from the electrical motor and can thus be turned when so desired, for instance when exchanging the draw sheet. Naturally, always only one electrical magnet is effected, when one or the other of the buttons is pressed, so that even in driving position, one of the driving rollers is always disengaged.

Naturally, the parts or details of the first-described and illustrated embodiment may be combined or interchanged with parts of the embodiment of FIGS. 8 to 15 as may be practical. Accordingly, for instance, the whole driving system (or parts of the same) of the embodiment of FIGS. 8 to 15 can be used without swinging arms and spacing strut, and may incorporate the driving system of the first-described embodiment.

Furthermore, it is of course, possible to use the apparatus of FIGS. 8 to 15 for lifting up a patient, e.g. when making the bed. For this, the non-driven roller can be arranged to be locked in any suitable way, so that the driving roller can lift the draw sheet with the patient on it. Alternatively, both rollers can be driven in opposite directions to achieve the lifting. If the draw sheet is relatively narrow and needs to be wider for supporting a person along her substantial length, either stiff extension means may be provided temporarily under the patient and upon the draw sheet, or the driving rollers may be extended or exchanged, possibly with the aid of support means, which can be attached to the frame.

The invention is not limited to the embodiments described above and illustrated in the accompanying drawings, but can be modified and varied in any way within the scope of the scope of the invention as defined by the accompanying claims. Accordingly, the most vital parts of the apparatus according to the invention can be applied directly to a bed without the described and shown support construction, which can be constituted entirely or partly by the bed itself. Furthermore, the rollers may be carried by a hydraulic lifting and lowering device, so that one can lift up the patient for making the bed on the draw sheet, which may be wider or supported by one or several special supports or the like. Said friction protector may also be attached to the rollers outside of the draw sheet, e.g. by means of sliding hooks, which may elastically snap on. Then, one can use narrower friction diminishing straps or even threads or ropes.

I claim:

1. Apparatus for turning a person confined to bed, comprising a substantially U-shaped support means surrounding the bed in the middle and from below, said support means including vertically disposed posts extending up to mattress level;

a pair of rollers disposed along, and parallel to, each long side of said bed, each roller being supported, by a pair of said posts, for rotation about its axis of rotation;

each end of said rollers concentrically carrying bolt means, and each of said posts carrying bearing means for rotatably supporting said bolt means;

means for rotatably driving one of said rollers;

means, carried by at least one of said posts, for moving said bolt means and said driving means relative to one another between a first position wherein said bolt means and said driving means are engaged and a second position werein said bolt means and said driving means are disengaged, said moving means comprising pin means carried by said driving means and recess means carried by said bolt means, said pin means and said recess means extending normal to the axis of rotation of said bolt means; and a draw sheet connected to, and spanning the distance between, said rollers, said draw sheet extending across the upper side of said bed.

2. Apparatus as claimed in claim 1 in which opposing ends of the draw sheet are engaged in elongated slots in the roller, said draw sheet having a width corresponding to less than the length of said bed.

3. Apparatus as claimed in claim 1, wherein said driving means includes a drive motor, and said posts are tubes which house said roller driving means, the latter comprising toothed wheels connected to the rollers at the upper end of the tubes, reversing rollers located at a lower end of the tubes, and endless chains engaging said toothed wheels, said reversing rollers, and said drive motor means.

4. Apparatus as claimed in claim 3 wherein the drive motor is an electric motor connected to a transformer, the latter being connected to a manoeuvring unit with a pressure button actuator for each turning direction of the motor the rollers and the draw sheet.

5. Apparatus according to claim 3, characterised in that said support means comprises four posts and includes traverses or struts interconnecting said posts longitudinally and transversely of the bed at least some of said traverses being adjustable in the longitudinal direction, the supporting means resting on height adjustable feet, and spacers bridging the gap between the posts and the bed body and interconnecting the bed with the apparatus to form a solid unit.

6. Apparatus according to any preceding claim, wherein said moving means comprises an engagement cylinder having an outer flange one end of which is turned away from the roller, said cylinder being freely rotatable on said roller end, the other cylinder and being provided with a stop ring including a basically freely rotatable tooth wheel around which one of said chains extends, and on which is mounted a clutch for clutching it to the cylinder.

7. Apparatus according to claim 6, wherein said clutch comprises two recesses arranged diametrically on the inside of the tooth wheel facing said driving bolt means, one end of which, in circumferential direction, extends substantially radially away from the cylinder, forms a gently rounded cavity for a locking roller of somewhat smaller diameter than the greatest depth of the cavity in the radial direction and merges gently into the other end of the cavity by a continuous approach thereto in the tangential direction, and finally abuts and terminates at the cylinder, and wherein both recesses are shaped in an analogous way in the same circumferential direction.

8. Apparatus according to claim 6 wherein a pressure spring is provided to press the moving means against the engagement means, while a freezing force acting in the opposite direction and against the pressure spring is provided by an eccentric on the outer side of the respective post which side is turned away from the roller, which eccentric extends into an axial space between said cylinder flange and said tooth wheel by an engagement ring with an interior flange.

9. Apparatus according to claim 1, wherein an electromagnet, which preferably is electrically connected to a manoeuvring unit and a driving source of the apparatus, is disposed between said driving source and said driven roller said electromagnet coupling only said driven roller with the driving source while the other roller remains disengaged.

10. Apparatus according to claim 9, wherein said driven roller is supported by the free ends of swinging arms, the base end of each of said arms being attached to the upper end of two posts of the apparatus at one longitudinal side of said bed pivotably, and arrestably, in different positions, a spacing strut extending between said base ends, toothed wheels carried within said swinging arms including an endless chain engaging said wheels to connect the driving rollers with the driving source via a clutch and means for arresting said swinging arms in at least one position.

11. Apparatus according to claim 9, wherein the posts of the apparatus are tiltable and arrestable in at least one position without affecting the driving device of the apparatus.

* * * * *